United States Patent [19]

Barry

[11] 3,946,810

[45] Mar. 30, 1976

[54] IN SITU RECOVERY OF HYDROCARBONS FROM TAR SANDS

[75] Inventor: Charles B. Barry, Houston, Tex.

[73] Assignee: The Ralph M. Parsons Company, Pasadena, Calif.

[22] Filed: Nov. 7, 1974

[21] Appl. No.: 521,552

Related U.S. Application Data

[62] Division of Ser. No. 363,596, May 24, 1973, Pat. No. 3,881,550.

[52] U.S. Cl. ..... 166/272

[51] Int. Cl.[2] ..... E21B 43/16

[58] Field of Search ..... 166/272, 274, 275, 266, 166/265, 267, 303

[56] References Cited

UNITED STATES PATENTS

| | | | |
|---|---|---|---|
| 2,862,558 | 12/1958 | Dixon | 166/272 |
| 2,897,894 | 8/1959 | Draper et al. | 166/272 |
| 3,057,404 | 10/1962 | Bergstrom | 166/267 |
| 3,221,813 | 12/1965 | Closmann et al. | 166/272 X |
| 3,358,756 | 12/1967 | Vogel | 166/272 X |
| 3,474,863 | 10/1969 | Deans et al. | 166/272 X |
| 3,500,916 | 3/1970 | van der Knaap et al. | 166/272 |
| 3,500,917 | 3/1970 | Lehner et al. | 166/272 |
| 3,695,354 | 10/1972 | Dilgren et al. | 166/266 X |
| 3,837,399 | 9/1974 | Allen et al. | 166/266 |
| 3,838,738 | 10/1974 | Redford et al. | 166/272 X |

FOREIGN PATENTS OR APPLICATIONS

| | | | |
|---|---|---|---|
| 1,112,956 | 5/1968 | United Kingdom | 166/272 |

*Primary Examiner*—Ernest R. Purser
*Attorney, Agent, or Firm*—Christie, Parker & Hale

[57] ABSTRACT

Hydrocarbon products from viscous tar sands are recovered by continuously injecting a hot solvent containing relatively large amounts of aromatics into the formation. Alternatively, steam and solvent are cyclically and continuously injected into the formation to recover the values. The last stimulation is by steam so that solvent is recovered. A third alternative is to continuously inject a mixture of steam and solvent vapors and liquid into the formation. In all cases, the solvent, except perhaps for startup, is produced at the site, as in a conventional topping unit, which alternatively is combined with a conventional visbreaking or reforming unit to increase the volume and/or aromaticity of the solvent produced.

10 Claims, 3 Drawing Figures

IN SITU RECOVERY OF HYDROCARBONS FROM TAR SANDS

This is a division of Ser. No. 363,596, filed May 24, 1973, now U.S. Pat. No. 3,881,550.

BACKGROUND OF THE INVENTION

The present invention relates in general to the art of oil recovery and, more in particular, to recovery of hydrocarbons from heavy crudes or bitumens by stimulation.

There are large petroleum deposits in the form of very viscous crudes or bitumens. These deposits may be residuals from naturally developed fields or deposits which have never been produced. An example of very viscous tar deposits is in the Peace river and Athabasca regions of Canada. These tars have a gravity of from 6° to 20° API, a clean oil viscosity of to 20,000 cps, and an emulsion viscosity of to more than 100,000 cps. The asphaltene content of these deposits is up to 30% and sulfur up to 6%. Because these tars are so viscous, they cannot be recovered by natural techniques and must be stimulated.

Stimulation of petroleum deposits by steam flooding is a known and tested technique. In this type of stimulation, high pressure and temperature steam is injected into injection wells for recovery of petroleum from production wells. During steam stimulation, steam heats a deposit in a steam zone. Values are distilled there and are forced by steam pressure away from the injection wells towards the production wells. Some of the distilled hydrocarbons will condense in the steam zone because of heat loss from the zone to surrounding strata. Some of the distilled hydrocarbons will reach a front between a hot condensate zone and the steam zone and condense there. The driving force of the steam pressure, however, continuously advances the condensed hydrocarbons towards the production wells. The hot condensate zone itself fronts on a cold water zone more remote from the steam zone. Finally, there is an oil zone bordering the cold water zone which is the formation unaffected by stimulation. In typical steam flooding, the cold water zone is water flooded and oil is removed by this known technique to the water flooding saturation level. The advancement of the hot condensate zone itself stimulates recovery by lowering viscosity of the oil and by thermal expansion of the oil. Within the steam zone, recovery is promoted, in addition to distillation, by the temperature produced agencies of viscosity reduction and formation swelling. Hydrocarbons are usually recovered at the production wells in primarily liquid form. The considerable driving force of the steam flooding technique is ultimately lost when breakthrough occurs at a production well. This is an event where the steam front advances to the production well and steam pressure is largely dissipated in the well. The well becomes a short circuit. After steam stimulation, the usual practice is to produce without stimulation until further stimulation is necessitated or production terminated.

Obviously, in the steam flooding technique distillation plays only a modest role at best for very heavy crudes such as the Peace River bitumens because they do not contain any considerable light values. Consequently, the action of steam in stimulating recovery from deposits such as the Peace River bitumens must be by viscosity reduction from heating, thermal expansion of the formation, and the driving force of the steam. Even then, recovery can be modest because of channeling resulting from the permeability of the deposits, fractures, and gravity override between the steam and liquid in the hot and cold zones.

Importantly also, is the effect of even modest distillation on bitumens or tars. With these crudes, the boiling away of lights will cause the residual crude to become so viscous that no further recovery would be possible, even with the viscosity lowering effect of high temperature from the steam.

Consequently, it has been thought that steam drive recovery is limited to deposits with an API gravity of 20° or greater.

Cold solvent stimulation of oil deposits has improved recovery. Solvents can repair organic and inorganic damage, clean deposited asphaltenes and waxes out from around well bores, and lower the viscosity of the hydrocarbons in the deposit by cutting and demulsification. Demulsification reduces the viscosity of the hydrocarbon deposit because emulsions of water-in-oil and oil-in-water have higher viscosities than oil alone. Solvent stimulation also removes asphaltenes from the deposits. Removal of asphaltenes is especially good with aromatics.

The removal of crude oil from the deposit, however, can create a situation where the solubility of remaining asphaltenes is reduced. Remaining asphaltenes precipitate on surfaces of the deposit and block the passage of crude. Accordingly, to prevent asphaltene precipitation and blockage of the deposit, surfactants have been added to maintain the wetability of deposit surfaces, which prevents blockage.

One of the major drawbacks of solvent stimulation is the high cost of solvent. Quite obviously, if the cost of solvent required to produce effective stimulation of a deposit becomes too great, then solvent stimulation cannot be practiced. Heretofore it has been the practice to produce at least most of the solvents away from the stimulation site. This is so especially with aromatic solvents which are very useful in dissolving asphaltenes.

SUMMARY OF THE INVENTION

The present invention provides solvent stimulation of hydrocarbon deposits having extremely high viscosities, such as found in the Peace River region of Canada.

In brief, the present invention contemplates the use of a hot solvent generated from product on site to recover hydrocarbon product values from heavy crudes or bitumens. The hot solvent is injected into the deposit and functions to reduce deposit viscosity by demulsifying viscous emulsions of crude-in-water and water-in-crude, solvent cutting of crude and raising the temperature of the crude. The solvent also solubilizes production restricting precipitated waxes and asphaltenes. The solvent can be used to remove scale deposited from produced water, sand deposited around well bores, and drilling and completion damage. The solvent is introduced at a temperature of from about 200° to about 650°F. and is preferably depentanized naphtha of up to about an 800°F. end point. This naphtha has substantial quantities of aromatics, the aromatics being useful in the dissolving of asphaltenes and waxes. The solvent may be manufactured from recovered bitumen by topping or by a combination of topping with visbreaking or reforming. Surfactants may be added to the solvent to prevent deposition of asphaltenes on deposit formations by keeping surfaces in the formation water wetable. Suitable surfactants are butylamines or mixed alkyl phenols.

The presently preferred embodiment of the present invention contemplates the use of both solvent and steam extraction of hydrocarbon values from tars or bitumens typified by the Peace River deposits. This is done by either injecting steam and solvent vapors and liquids continuously into the formation or by cyclic injection of steam and hot solvent. With steam, thermal reduction in crude viscosity results and reservoir fluids expand. There will be some, though small, distillation of hydrocarbons by the steam from heat and partial pressure reduction. With the decrease in viscosity, gravity drainage is promoted. The steam pressure, say, 1500 p.s.i.a. at injection, will strongly drive crude towards production wells.

The steam-solvent process retains the production resulting from thermal stimulation of deposits by the steam while eliminating or minimizing production restrictions occasioned by viscous emulsions, precipitated waxes and asphaltenes, scale and sand deposition, and drilling and completion damage.

When steam and solvent are used together, the difficult problem of solvent-crude mixing is not present because the steam is a low viscosity fluid which will rapidly fill all available voids in the reservoir and carry solvent with it. The solvent can then function more completely throughout the formation.

DESCRIPTION OF THE PREFERRED EMBODIMENT

Figure 1:
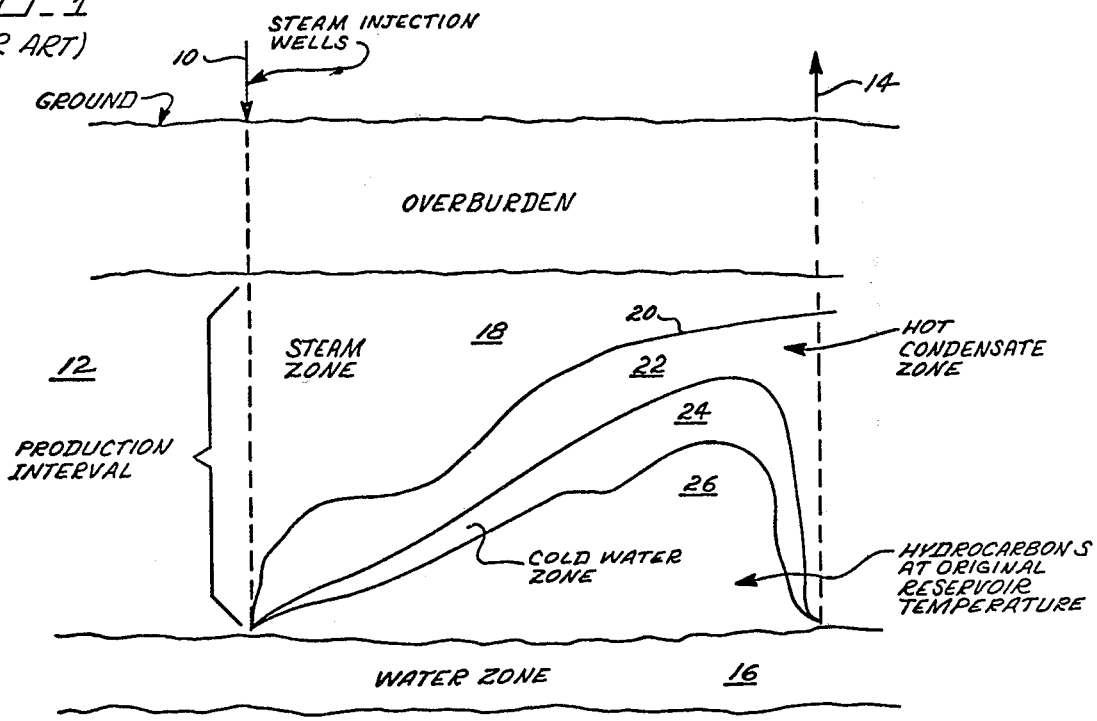
FIG. 1 (PRIOR ART)
FIG. 1 illustrates schematically a prior art steam driving technique for the recovery of hydrocarbons as it would apply in tar deposits of the Peace River type.

FIG. 1 illustrates schematically a typical steam drive system which has been implemented before the present invention. Its description is helpful in understanding the principles behind the process of the invention.

In the Figure, injection wells 10 are provided through overburden and to and through tar sands 12. The overburden is, say, 2000 feet and the production interval is, say, 100 feet. In the Peace River deposit, the production interval varies from about 50 to about 1000 feet. Production wells 14 are also provided through the overburden and the production interval.

Steam of a quality of 70 to 80% and at a pressure up to about 2500 p.s.i.a. and at about 668°F. is injected into the injection wells. A pressure seal in the overburden prevents backflow of this steam from either the injection wells or production wells.

The gravity of the tars or bitumen in the Peace River deposits is from about 6° to about 20° API. The clean oil viscosity is up to about 20.000 cps. In the emulsion, however, the viscosity increases to more than 100.000 cps. The asphaltic content of the Peace River type of tars is up to about 30%. The sulfur content is also high, being up to about 6%. The tar sands may be bottomed by a water zone indicated at 16.

Steam injected through the injection wells will progress from that well radially toward the production wells. During the steam drive, a steam zone 18 will continuously expand radially away from the steam injection well. Within the steam zone hydrocarbon vapors will be generated, but immobile hydrocarbons will remain. Owing to temperature rise, the deposit will also expand and there will be a reduction in viscosity. A steam front 20 separates a hot condensate zone 22 from the steam zone. Along this front and into the hot condensate zone condensation of hydrocarbon vapors will occur as steam condenses. Within the hot condensate zone, the temperature varies from steam temperature to reservoir temperature. The hot condensate zone, as is the case in the steam zone, progressively increases with time. Reservoir heating in the hot condensate zone is augmented by the latent heat of the steam and condensing hydrocarbon vapors. A cold water zone 24 is ahead of the hot condensate zone and receives some heat from fluids passing into it from the hot condensate zone. The balance of the reservoir indicated at 26 and is at the original reservoir temperature. As will be seen, with a steam drive system alone, no production occurs from this zone because the hydrocarbons are too immobile to be recovered at the original reservoir temperature.

A production mechanism in the steam drive system illustrated in FIG. 1 is the steam distillation of hydrocarbons in the steam zone. The transfer of the heat energy from the steam to the reservoir deposits will thermally expand these deposits which also results in the production of hydrocarbons. The heating of the deposit also reduces viscosity which makes the oil values there more mobile and results in production. The heated hydrocarbons will drain by gravity and be recovered at the production wells which may have bottom hole pumps. A driving force form the pressure differential between the injection wells and the production wells will continuously force hydrocarbons towards the latter for recovery.

Prior techniques of steam stimulation also include the so-called "huff" and "puff" system. In this system, steam is injected for a considerable period of time into a well without attendant oil production. The injection steam is eventually stopped and oil production commences with the stimulation by steam improving the production rate from the well for a time. Ultimately, the well may be restimulated or not, depending on economics. This technique is an alternative to that known as the "steam drive" discussed above.

FIG. 1 also shows a condition which is known as steam breakthrough during steam drive. Steam breakthrough occurs when steam appears at the production wells. The result of this phenomenon is the loss of the driving pressure of the steam and a marked diminution in the efficiency of the system. A second phenomenon is also illustrated in FIG. 1, and that is steam channeling. It will be noted that the steam zone breaks through at a production well along a very short vertical distance. This channeling is the result of gravity override, permeable strata and horizontal fractures in the reservoir. Gravity override results from the different densities of the steam and the condensate, with the latter tending by gravity toward lower depths. When steam breakthrough occurs, economy precludes continued steam injection, for excessive heat is lost to surrounding strata and is vented up the casing of the production well, this notwithstanding continued gravity drainage due to the rise in temperature of hydrocarbon values in the reservoir. Other problems encountered in the steam drive system is the production of extremely viscous emulsions of oil-in-water and water-in-oil. As previously mentioned, emulsion viscosities can exceed 100,000 cps.

The problem of hydrocarbon immobility from excess viscosity is compounded by removal of distillates from the formation by the steam distillation in the steam zone.

The precipitation of waxes and asphaltenes can effectively block recovery of hydrocarbon values and this precipitation can occur when lighter hydrocarbons are taken from the reservoir. Scale deposition from produced water can also reduce recovery. Steaming can also result in sand deposition around well bores with the result that recoveries are adversely affected. Finally, drilling and completion damage adversely affect recovery.

Figure 2:
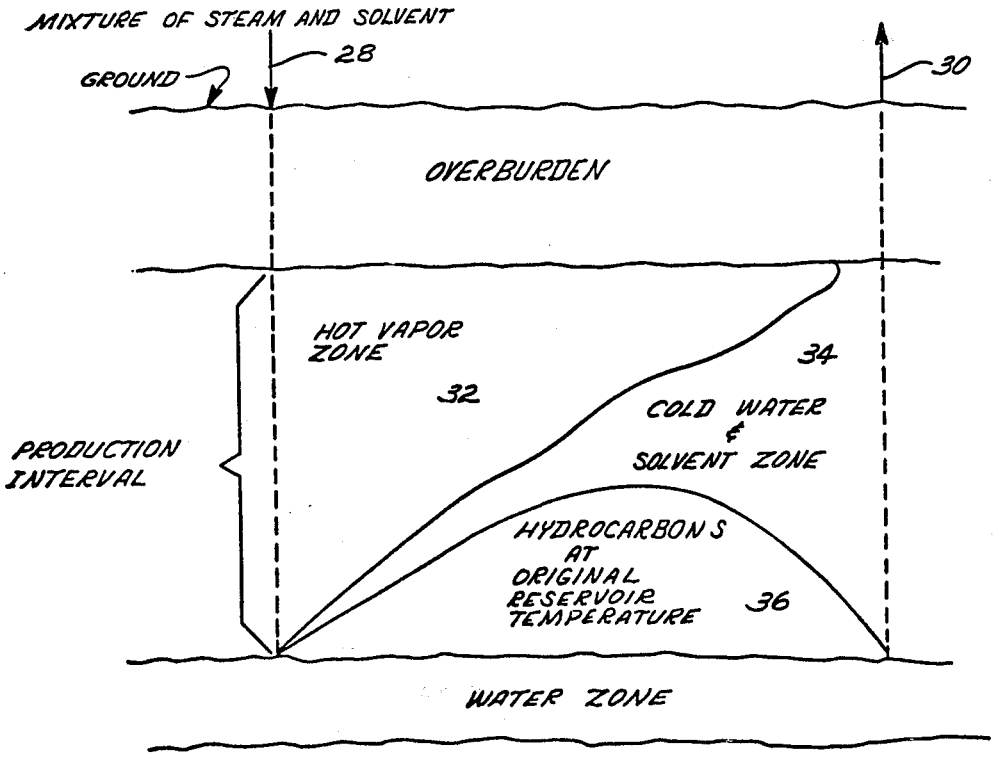
FIG. 2 illustrates schematically steam and solvent recovery of hydrocarbon values in a deposit of the Peace River type.

These problems are reduced by the implementation of hot solvent stimulation of the present invention. The solvent is produced at the production site. With reference to FIG. 2, injection wells 28 are formed in the same manner as the injection wells of FIG. 1. Similarly, production wells 30 are formed in the same manner. The overburden and production zones and water zones are the same. In FIG. 2, production of hydrocarbons is effected by the injection of a mixture of steam and solvent vapors and liquid. The solvent is in two phases, that is, both liquid and vapor. Since the steam has a quality of less than 100% a water phase is also present.

An important aspect of the present invention is the manufacture of solvent on site. THe solvent should have a relatively low viscosity and a high aeromatic content. An ideal solvent is depentanized naphtha having a maximum end point of up to about 800°F.

The production mechanism of the FIG. 2 system includes an increase in mobility of the hydrocarbons through viscosity reduction. Viscosity reduction, as in the steam drive system, results from temperature rise. But in addition to the purely thermal effects of viscosity reduction, an important reduction in viscosity will also be the result of solvent cutting or mixing with the hydrocarbons of the reservoir and the demulsification of the extremely viscous emulsions within the reservoir. This production mechanism also results in thermal expansion of the reservoir fluids due to their heating by both the steam and the solvent. The thermal expansion results in the release of hydrocarbons for recovery. The steam-solvent system also recovers values by gravity drainage. The reduction in viscosity and increased mobility allows hydrocarbon values to drain for recovery. Again there is a driving force because of the pressure differential between the injection fluid at the injection well and the produced fluid at the production well. The steam may act as a solvent carrier to expose a considerable amount of the deposit to the solvent.

Steam channeling will again occur due to the factors previously set forth, gravity override, permeability of strata, and horizontal fractures. However, the steam channeling may be effectively used to disperse solvent throughout the reservoir. This solvent also prevents precipitation of waxes and asphaltenes at the well bores and washes out scale, sand, and drilling and completion damage.

In FIG. 2, a hot vapor zone 32 is illustrated and it has a front with a cold water and solvent zone 34. The unaffected portion of the reservoir is shown at 36 and it has the originally constituted hydrocarbons at original reservoir temperature. It should be noted that the use of both steam and hot solvent as recovery vehicles results in greater recovery. The hot solvent conditions the deposit for greater thermally induced recovery over that which would result from steam alone.

Initially, with deposits such as in Peace River, about 10 to about 25% of the gross product is recycled as hot solvent, after the solvent is made by the processing steps set out below. As the process continues, the gross product increases because the injected solvent is being recovered with the crude. It is possible that product solvent will be left over.

The making of the solvent on site is inexpensive and, with surplus product solvent sold with crude, the quality of the crude increases. Solvent purchased for stimulation, say, cyclohexane, is normally much more expensive than the products produced.

In the simultaneous injection of steam and solvent, in general for each barrel of crude produced and removed from the reservoir, there then may be used about 3⅔ barrels of water converted to steam and about ⅓ barrel of solvent produced. This ratio, however, is no wise limiting and any ratio of steam to solvent may be employed depending on conditions and process economics.

The solvent produced, such as depentanized naphtha having a high aromatic content, should be heavy enough to dissolve the heavier hydrocarbons of the bitumen, but not so heavy as to create mobility problems and remain in the formation. The preferred solvent has a boiling point range of from about 200° to about 800°F. An acceptable range is from about 200° to about 500°F. The solvent must have a high aromatic content to dissolve asphaltenes. Small quantities of non-ionic surfactants may be used with the solvent. These surfactants are useful in maintaining the wetability of the deposit being processed so that precipitated asphaltenes will not prevent recovery.

As was previously mentioned, hot aromatic solvent will break highly viscous emulsions in the reservoir. They also increase crude temperature and, as such, further decrease the viscosity of the crude.

The present invention also contemplates the cyclic introduction of steam and solvent. The steam stimulates in the manner previously described, i.e., primarily by viscosity reduction and formation swelling, resultant gravity drainage, and pressure drive. In the steam zone, distillation of some values will occur. These values form a solvent slug.

After steam termination the solvent is injected hot at from about 200° to about 650°F, to stimulate the steam flooded formation by demulsification, solvent cutting and temperature effects. The solvent cleans up the deposit by removing asphaltenes, waxes, sand and the like. With demulsification, solvent cutting and removal of asphaltenes, the residual crude is conditioned for processing again by steam.

As indicated steam is injected first and steam injection continues until breakthrough at a production well. Steam injection is then terminated and hot solvent injection commenced. Solvent injection is continued until the solvent-to-crude ratio is about 1 to 3. Steam is then injected again until breakthrough. Steam is always injected last to recover solvent from the deposit. As an alternative the "huff" and "puff" technique may be employed with solvent and steam, or steam followed by hot solvent injected into the well for a period of time during which production is periodically terminated while stimulation occurs.

The present invention also contemplates recovery of hydrocarbons from highly viscous deposits of tars or bitumens by hot solvent stimulation alone. The solvent is injected into the injection wells at a temperature of from about 200° to about 650°F. The solvent is produced from recovered crude at the site and is preferably depentanized naphtha having an end point of less than about 800°F. The solvent has a high aromatic content for the solubilizing of asphaltenes. The production mechanism is demulsification of oil-in-water and water-in-oil emulsions, solvent cutting of heavy components of the crude, some formation heating, and removal of physical and chemical impediments to production in the formation.

Figure 3:
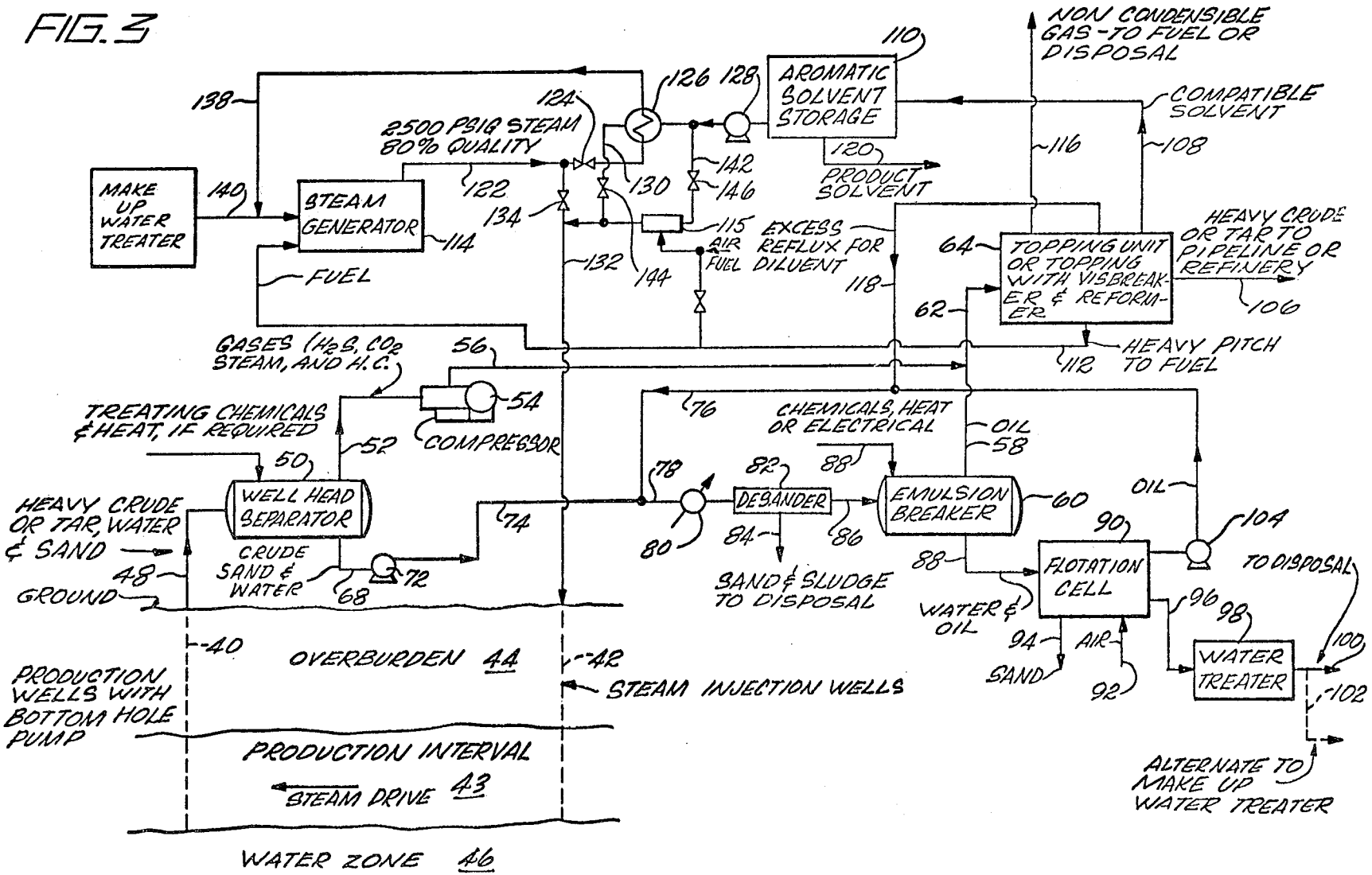
FIG. 3 is a flow diagram of a plant for the implementation of the process of the present invention.

With reference to FIG. 3, a system to implement the present invention is illustrated. Again there are a series of production wells that may be bottom-hole pumped. These wells are indicated by the single line 40. A series of steam injection wells are provided at 42. A production zone or interval 43 is the same as in the previous Figures, that is, it varies from 50 feet to 1000 feet and is very heavy in tars of the type found in the Peace River deposits. The production zone has a fairly thick overburden 44 on it and is bottomed by a water zone 46.

Product from the recovery leaves the deposit as a steam 48 and consists of heavy crude or tar, water and sand. Stream 48 is introduced at the well head into a separator 50. The separation is of the gaseous constituents of the product and steam from liquid product, sand and water. The gaseous constituents are $H_2S$, $CO_2$, steam and light hydrocarbons and they leave the separator as a stream 52. The well head separator is provided to measure the production streams and also provides a preliminary breakup of emulsions, which may be by known chemical treatment with the addition of heat, if required. Stream 52 is compressed in a compressor 54 and a compressed stream 56 is introduced into a stream 58 from an emulsion breaker 60 to form a new stream 62. The stream from the emulsion breaker contains crude oil. The united streams enter a topping unit 64, such as a distillation column.

A crude oil, sand and water stream 68 leaves well head separator 50, passes through a pump 72 before entering line 74. The stream 74 is combined with a recycled stream of light hydrocarbons 76 as a diluent to constitute a stream 78 which passes through heater 80 into a desander 82. A sand and sludge stream 84 from the desander goes to disposal. A stream 86 from a desander enters emulsion breaker 60 where the emulsion is further broken. The requisite input for emulsion breaking is indicated by the flow arrow 88. Emulsion breaking may consist of chemical dehydration, chemical-electrical treaters, flotation and skimming, filtration, centrifuging, or a combination of these methods.

Crude oil stream 58 from the emulsion breaker combines with gas stream 56 to form a stream 62 which is introduced into topping unit 64, which may include a visbreaking and/or reforming unit to increase the aromaticity of the solvent produced.

A water and oil stream 89 leaves the emulsion breaker and is introduced into a flotation cell 90. In the flotation cell, air is introduced at 92 and the water and oil are separated. In addition, any residual sand is separated from the water and oil, as indiciated by an egress sand stream 94. The separated water stream 96 from flotation cell 90 enters a water treater 98. There, the water may be treated in such a manner as to be suitable for disposal or, alternatively, for makeup water for a steam generator. Alternate streams for these purposes are indicated at 100 and 102, respectively. The oil stream leaving the flotation cell is a recycle stream and it passes by pump 104 for recycling as stream 76.

Sand slurry 94 is pumped to settling ponds where sand will be precipitated and retained water and oil returned to the process plant. Surplus water not required for the sand slurry mix is directed to settling ponds for skimming remaining oil contaminants and for final settling before being returned to a feed water treatment facility of the plant or a water disposal facility.

Water pumped to flotation cell 90 is air injected to cause any remaining oil particles or sediment to float to the surface. These oil particles or sediment are skimmed resulting in very clean water. Water can be further purified by pumping it through diatomaceous earth filters. Water treatment may also include its softening to zero hardness.

Stream 62 entering topping unit 64 provides on-site generation of solvent for the recovery process. The topping unit may also employ visbreaking and reforming, the latter operations being employed to increase the aromaticity of the solvent and provide, where necessary, a sufficient volume of solvent to recover very heavy tars such as 6° to 8° A.P.I. tars. The products of the topping unit include heavy crude or tar, which leave the topping unit as a stream 106. The generated solvent leaves the topping unit as a stream 108 and goes to a solvent storage facility 110. This solvent is high in aromatic content. The high aromaticity is valuable in removal of asphaltenes from the deposit. A heavy pitch stream 112 from the topping unit provides fuel for a steam generator 114 and/or fired tubular heater 115. Noncondensable gases are taken from the topping unit as a stream 116. These gases can be used as fuel or can be disposed of in any other suitable manner. An excess reflux stream 118 is introduced into stream 76 to provide a diluent for the stream entering emulsion breaker 60.

Excess solvent may be taken from solvent storage as a stream 120, or earlier, as product solvent, which may be commingled with the heavy crude as tar or sold separately.

Stream from steam generator 114 passes through a line 122 and may be:

a. combined with solvent in the recovery of values from the deposit,
b. used in cyclic flooding of the deposit with steam and solvent, or,
c. used to heat solvent for the introduction of hot solvent in a solvent flooding production process.

For the production of hot solvent, steam passes through line 122, which is valved at 124, and into a heat exchanger 126 where it passes in heat exchange relationship with the aromatic solvent pumped through the heat exchanger from storage 110 by a pump 128. The solvent is heated to a temperature of from about 200° to about 650°F. The hot aromatic solvent is then introduced through a line 130 and into a line 132 downstream of a valve 134 in line 132. Line 132 goes to the injection wells. Steam in the heat exchanger is condensed and the steam condensate stream 138 is used as makeup for the steam generator and is introduced to thee generator in a stream 140.

Another alternative is to introduce the steam and solvent together. This may be done by a line 142 from solvent storage 110 which bypasses heat exchanger 126 and joins line 130 to the injection wells. In this instance a valve 144 in line 130 is closed and a valve 146 in line 142 is open. On the steam side, valve 124 is closed and valve 134 is open. The result is that both steam and solvent pass through line 132 to the injection wells.

For the introduction of steam and solvent in a cycle, valves 124 and 134 are alternately opened and closed on the steam side, and on the solvent side valves 144 and 146 are alternately opened and closed.

The steam generated from generator 114 is at high temperature and pressure and is of a quality substantially lower than 100%, say, 80%. The reason for this quality is that the water can prevent scale buildup in the steam generator and ancillary lines.

The maximum introduction pressure of steam into the formation is set by formation and overburden characteristics and for 2000 feet of overburden will average about 1500 p.s.i.g. This requires that the steam generator have a maximum working pressure of about 2500 p.s.i.g.

In cases where hot solvent alone is used to stimulate the reservoir the solvent may be heated in a fired tubular heater 115 and this will, in general, be required if the solvent is employed at high introduction temperatures. Fired tubular heater 115 may be used in conjunction with steam heating of the solvent, in most instances steam and/or solvent temperatures should be maximized for maximum stimulation.

While the process has been described in terms of Canadian tar sands, the process of this invention is useful in recovery of carbonaceous values from many other deposits. Tar sands are found in the United States, Venezuela and other countries.

The process of this invention may also be employed to recover values from old oil fields which have been depleted by primay production i.e., natural production followed by water flooding. These systems do not recover the tars present. These fields may still contain from 40 to 90% of their original carbonaceous values as tars.

Yet another example are oil and tar deposits in which the crude is too viscous to process by conventional means or which would be uneconomic to process.

What is claimed is:

1. In a process for recovering hydrocarbons from a subterranean deposit of hydrocarbons having high viscosities including tar sands, oil and tar deposits by stimulating the deposit through the injection of fluid, an improvement which comprises:

a. simultaneously injecting steam and a solvent of high aromatic content produced from the hydrocarbon deposit;
b. carrying the solvent by the steam into the deposit;
c. heating the hydrocarbon in the deposit by the steam and solvent to thereby decrease its viscosity;
d. thermally expanding the deposit by the steam and solvent to release hydrocarbons therefrom;
e. breaking viscous emulsions by the solvent;
f. dissolving contained waxes and asphaltenes by the solvent;
g. cutting heavy hydrocarbons by the solvent; and
h. recovering hydrocarbons from the deposit at least in part by a pressure drive of the injected steam and solvent and producing from the recovered hydrocarbon a solvent of high aromatic content for reintroduction with steam into the deposit.

2. The improvement claimed in claim 1 wherein the solvent is depentanized naphtha having a maximum end point of about 800°F and having a substantial quantity of aromatics.

3. The improvement claimed in claim 1 wherein the solvent has a boiling point range of from about 200° to about 500°F.

4. The improvement claimed in claim 1 wherein the solvent is produced by topping recovered hydrocarbons.

5. The improvement claimed in claim 4 in which the aromatic content of the solvent is further increased by reforming.

6. The improvement claimed in claim 4 wherein the solvent has a boiling point range of from about 200° to about 500°F.

7. The improvement claimed in claim 4 in which the aromatic content of the solvent is further increased by visbreaking.

8. The improvement claimed in claim 7 wherein the solvent has a boiling point range of from about 200° to about 500°F.

9. The improvement claimed in claim 4 wherein the solvent is depentanized naphtha having a maximum end point of about 800°F. and having a substantial quantity of aromatics.

10. The improvement claimed in claim 9 wherein the steam and solvent are both injected into the deposit in liquid and vapor phases.

* * * * *

UNITED STATES PATENT AND TRADEMARK OFFICE

CERTIFICATE OF CORRECTION

PATENT NO. : 3,946,810

DATED : March 30, 1976

INVENTOR(S) : Charles B. Barry

It is certified that error appears in the above-identified patent and that said Letters Patent are hereby corrected as shown below:

Column 4, line 34, "form" should read --from--.

Column 4, line 41, after "injection" insert --of--.

Column 5, line 30, "THe" should read --The--.

Column 8, line 46, "Stream" should read --Steam--.

Column 8, line 66, "thee" should read --the--.

Column 9, line 38, "primay" should read --primary--.

Signed and Sealed this

Thirtieth Day of November 1976

[SEAL]

*Attest:*

RUTH C. MASON
*Attesting Officer*

C. MARSHALL DANN
*Commissioner of Patents and Trademarks*